United States Patent [19]

Sease

[11] Patent Number: 4,631,882

[45] Date of Patent: Dec. 30, 1986

[54] MOLDING STRIPS AND ASSEMBLY THEREOF FOR MOUNTING A FLEXIBLE COVERING ONTO A SUPPORT SURFACE

[76] Inventor: R. Gregg Sease, 6457 S. Heritage Place West, Englewood, Colo. 80111

[21] Appl. No.: 705,596

[22] Filed: Feb. 26, 1985

[51] Int. Cl.[4] ..... A47H 13/00; E04B 1/00

[52] U.S. Cl. ..... 52/222; 52/716; 1100/395; 24/459

[58] Field of Search ..... 52/202, 203, 222, 273, 52/716–718, 410, 465, 468, 710; 24/455–462; 160/327, 368 R, 392–397

[56] References Cited

U.S. PATENT DOCUMENTS

| | | | |
|---|---|---|---|
| 1,120,686 | 12/1914 | Burrows | 160/397 X |
| 1,233,432 | 7/1917 | Worten et al. | 160/397 |
| 1,758,720 | 5/1930 | Sodergren | 160/392 |
| 1,772,780 | 8/1930 | Milone . | |
| 2,325,500 | 7/1943 | Fosberg | 160/395 X |
| 2,415,200 | 2/1947 | Willett et al. . | |
| 2,692,017 | 10/1954 | Lang . | |
| 2,784,781 | 3/1957 | Rhoades | 160/397 X |
| 2,978,022 | 4/1961 | Winnan | 160/394 |
| 3,220,469 | 11/1965 | Oehmig | 160/395 |
| 3,273,633 | 9/1966 | Seidmon et al. | 160/395 X |
| 3,304,995 | 2/1967 | Goldstein | 160/368 R |
| 3,657,850 | 4/1972 | Billarant . | |
| 3,783,931 | 1/1974 | Assael . | |
| 3,803,671 | 4/1974 | Stuppy et al. | 24/456 X |
| 3,822,734 | 7/1974 | Tombu | 160/327 X |
| 3,833,046 | 9/1974 | Tombu | 160/395 X |
| 3,848,380 | 11/1974 | Assael . | |
| 4,018,260 | 4/1977 | Baslow . | |
| 4,053,008 | 10/1977 | Baslow . | |
| 4,194,312 | 3/1980 | Connors et al. | 160/395 X |
| 4,197,686 | 4/1980 | Baslow . | |
| 4,267,876 | 5/1981 | Bloomfield 160 | 160/395 X |
| 4,403,642 | 9/1983 | Morris . | |
| 4,447,935 | 5/1984 | Ausnit | 25/456 |
| 4,472,862 | 9/1984 | Bloomfield et al. | 160/395 X |
| 4,532,744 | 8/1985 | Beneze et al | 52/222 |

FOREIGN PATENT DOCUMENTS

| | | | |
|---|---|---|---|
| 2339501 | 8/1977 | France | 160/392 |

*Primary Examiner*—Donald G. Kelly
*Assistant Examiner*—Richard E. Chilcot, Jr.
*Attorney, Agent, or Firm*—Timothy J. Martin

[57] ABSTRACT

A molding strip assembly comprising linear edge pieces adapted to form a structure for holding the edge of a flexible material. The edge pieces may be configured in a framework so that the material covers a desired support surface. One edge piece is a molding strip that has a mounting base and upwardly extending connecting wall and a raised support wall in spaced parallel relation to the base. A lip extends upwardly from the base, spaced from the connecting wall, and a retaining wall extends upwardly from the base between the lip and the connecting wall, and, with the connecting wall, forms a narrow groove. A mating locking member defines a moveable profile that is received by the molding element and has a top wall, a first, downwardly depending side wall that is positioned in the groove to trap the material edge therein, and a second downwardly depending side wall that has a locking structure configured to engage the lip of the molding element. A second locking structure may be formed between the groove and the first side wall. Cooperating, internal molding elements may be used within the framework and include second molding elements and second locking members that may simultaneously secure two edges of flexible material sections.

25 Claims, 14 Drawing Figures

MOLDING STRIPS AND ASSEMBLY THEREOF FOR MOUNTING A FLEXIBLE COVERING ONTO A SUPPORT SURFACE

BACKGROUND OF THE INVENTION

The present invention is directed to molding strips operative to attach a flexible covering to a support surface, such as a wall or the like. This invention includes the structure of the molding strips along with an assembly of the molding strips into a framework that is constructed to mount a covering over an area of the support surface. By way of example, the present invention may be utilized in the general field of wall upholstering wherein fabrics are secured over wall areas for design purposes. In addition to the design benefits of the surface covering system, the present invention is directed to providing both thermal and acoustical enhancement at the region so covered.

While the use of flexible coverings such as tapestries and drapes, has origins centuries ago, there has recently been a renewed interest in flexible coverings among designers since the use of such materials expand the design possibilities for covering surfaces such as room walls and the like. The need for energy savings in modern times has further stimulated this interest since it has been learned that the combination of wall coverings with insulating material to some degree provide the thermal barrier preventing heat transfer from an internal enclosure and the external environment. Recently, it has been recognized that these wall covering systems may improve the acoustics of a room so as to reduce noise pollution.

In the past, designers have employed two primary methods of attaching a flexible covering to a support surface, such as a wall and the like. One method utilizes an adhesive that may be spread over the support surface with the fabric then being relatively permanently adhered to the surface such in the manner of wallpaper. Although this technique securely mounts a fabric covering to a wall surface, it has several drawbacks. First, as a result of its relative permanency, the removal of the flexible covering often damages the wall thus necessitating costly repairs. Further, any imperfections in the wall's surface will show through the fabric or flexible material so attached.

The second technique, and the technique to which this invention is directed, employs a framework of mounting strips of moldings which extend around and across the area to be covered. The flexible covering is secured to the mounting strips without being directly adhered to the wall surface. While these molding frame systems provide a structure that is less damaging to the wall surface, it has been found difficult to releaseably secure the flexible covering the molding strip framework in a taut manner that avoids sagging or puckering of the fabric after a period of extended use. One such framework system shown in the prior art is described in U.S. Pat. No. 3,657,850, issued Apr. 25, 1972, to Billarant. In this assembly, a molding strip is provided that includes a storage channel positioned adjacent an attachment flange or "sole" which may be used to attach the molding strip to the support surface. Cooperating filaform elements are provided on the web of flexible material so that they may be positively engaged by the hooking elements on the sole. After such engagemaent, the marginal edge of the flexible material is stuffed through a narrow inlet so that it is stored in the molding strip's channel and retained therein by the narrow inlet. A T-shaped spline may be used to enhance the gripping force of the inlet's jaws to give further strength to this retaining structure.

Another prior art structure is described in U.S. Pat. No. 4,018,260, issued Apr. 19, 1977, to Baslow as supplemented by U.S. Pat. No. 4,053,008, issued Oct. 11, 1977, also to Baslow. In the assembly shown in these two patents, a framework of molding pieces is described which, when assembled, defines a pair of enclosed channels that extend around the peripheral of the area to be covered by the flexible fabric. The inner channel forms a locking structure by having an upwardly disposed inlet which receives a looped portion of the fabric. A compressible spline is enforced into the inlet to resiliently trap the loop of fabric therein; the excess edge portion of the fabric is then trained over the upper surface of the outer channel which is also provided with an inlet to receive the excess fabric therein. The cooperation of the side walls of the inlet, which form jaws that are resiliently biased towards one another, operate to hold the fabric in the channels. The upper surface of the molding piece may include an adhesive to aid in holding the fabric. A problem would arise from this construction, though, where tension of the fabric causes an opening of the jaws so that the fabric may slip therefrom.

In U.S. Pat. No. 4,197,686, issued Apr. 15, 1980 also to Baslow, another framework system is disclosed using molding strips that are attached to the wall by an attachment flange. In this system, a single storage channel is provided which has an inlet opening forming a pair of jaws oriented at the edge of the molding opposite the flange. Here, the material is trained over the upper surface of the storage channel and inserted through the gripping jaws so that it may be retained therein. Again, the problem of slippage may occur should substantial tension be placed on the material. The slippage can also be a function of the type of material to be retained in the storage channel, with some materials slipping more readily than others.

In U.S. Pat. No. 3,833,046, issued Sept. 3, 1974 to Tombu, mating profile elements are provided that clamp to one another to retain a flexible covering to a wall, with this system also being directed to enclosing an area of a wall surface. In the Tombu patent, a first profile is mounted to the wall surface and includes upwardly and inwardly curved legs that are bent towards one another. A clamping element is mateably received by these pair of legs in a "snap-lock" manner. Before mating the two profiles, though, the fabric is trained across the front of the second profile, across a far end, and back along the second profile's back surface. The second profile is then snap-locked in the first profile so that it is either retained by the jaw-like action between the second profile and the first profile's leg or by means of separate splines located at the back of the second profile. Several alternate embodiments to this invention are shown including simple, U-shaped channels and U-shaped strips that are inserted in these channels to frictionally secure a flexible covering between the channel and the channel insert.

Other prior art clamping structures are shown, for example, in U.S. Pat. Nos. 3,783,931, issued Jan. 8, 1974 to Assael and 4,403,642, issued Sept. 13, 1983 to Morris. In addition to these fabric attachment systems, numerous clip and spline assemblies for attaching flexible window screens are known in the prior art. Examples of such structures are shown in U.S. Pat. Nos. 1,772,780, issued Aug. 12, 1930 to Milone, 2,415,200, issued Feb. 4, 1947 to Willett et al, and 2,692,017, issued Oct. 19, 1954 to Lang.

Although these prior art structures accomplish the broad objective of mounting a flexible fabric to a wall, there remains a need for a simple, efficient molding strip assembly that releaseably retains a flexible wall covering in a secure, taut manner. There is a further need to provide a structure and a system for securely yet releaseably mounting flexible coverings to support surfaces and such is the manner to increase the flexibility fo the system from a design standpoint to provide a more pleasing, aesthetic appearance.

SUMMARY OF THE INVENTION

It is an object of the present invention to provide a novel and useful molding strip assembly which may be employed to mount a flexible covering to a support surface.

It is another object of the present invention to provide a support structure in the form of a framework assembly and flexible covering which is used in conjunction with a thermal and/or and acoustic bat to cover a surface area in such a manner that heat and noise transfer is retarded.

It is yet another object of the present invention to provide a molding strip assembly which may be configured into a framework that may mount a flexible covering over a desired area to completely cover that area in an aesthetically pleasing manner.

It is another object of the present invention to provide a molding strip assembly which may be configured into a framework including internal strip sections wherein the cooperating elements of which may be selected to give a variety of design appearances while retaining the covering in a secure, taut manner.

A still further object of the present invention is to provide molding strips that may be manufactured in an inexpensive manner, and that are easy to install without the resort to any special tools so that installation is inexpensive and not labor intensive.

It is a further object of the present invention to provide a molding strip assembly that may be configured into a framework to enclose a wall area which provides routing channels for items such as electrical lines, telephone lines, and fiber optics, if desired, and which includes structure to allow attachments for mounting of shelves which do not interfere with the flexible covering extending across the molding strip assembly.

To accomplish these objects, a molding strip assembly is described which is adapted to secure the edge of the flexible covering to a surface to which the molding strip is attached. A stationary, molding element includes a base wall that is operative to receive a fastening element, such as a staple, for attaching the molding element to a surface to which the flexible covering is to be secured. A connecting wall extends upwardly from the base wall to support a raised support wall in spaced relation to the base wall. A raised lip also extends upwardly from the base wall in space relation to the connecting wall and the retaining wall extends upwardly from the base wall between the lip and the connecting wall and in closely spaced apart relation to the connecting wall to define a narrow groove therebetween. A mating locking member defines a moveable profile that is received by the molding element. The locking member inclues a top wall, and first and second side walls depending downwardly therefrom. A first side wall is sized for insertion into the groove defined betwee the retaining wall and the connecting wall of the molding element, and the second side wall includes a locking structure that engages the raised lip on the molding element base wall so as to retain the locking member on said molding element with the first wall in mated engagement in the groove. The covering is secured to the surface by training the covering's edge across the support wall and along the connecting wall into the groove after which the first side wall of the locking member is inserted into the groove to trap the edge of the covering therein while the locking structure engages the lip to "snap-fit" the assembly together. A second locking structure may be provided for the groove and first side wall to further secure the locking member to the molding element.

In order to cover a surface, such as the wall of a room, a framework of molding strips are assembled into the geometric configuration of the area to be covered. A support structure is thus defined around the perimeter of the area to be covered. A section of covering is then cut to dimensions slightly larger than the framework to present excess edge portions around the framework that may be inserted into the respective grooves of the molding elements and trapped therein by respective locking members.

Preferably, a pressure-sensitive adhesive coats the upper surface of the raised support wall so that the flexible covering may be adhered thereto to further strengthen the attachment of the flexible covering to the molding strip assembly; the adhesive may cover the upper surface and extend downwardly into the groove. The raised support wall may also have a downwardly depending spacer wall opposite the connecting wall to position the support wall more rigidly against the support surface. Decorative coverings may be provided across the upper surface of the locking member's top wall. These decorative strips may either match, complement, or contrast the material defining the flexible covering so as to increase the variety of appearances to be designed for the covering. Likewise, the locking member may be formed of different materials to increase design flexibility. The respective support walls and top walls can also be configured as desired, for aesthetic appeal.

Where a large surface area is to be covered, the framework assembly may include second cooperating molding elements having a second base wall which receives the fastening elements. A pair of second connecting walls extend upwardly from the second base wall, in spaced relation to one another, and terminate in laterally projecting second support walls extending outwardly thereform. Detents are provided at each corner of the second connecting walls and the second base wall, and a second locking member may be mounted in the channel formed by the connecting walls. A second locking member has a second top wall and a pair of side walls depending downwardly thereform with each side wall terminating in a locking structure that engages the detents to snap-fit the second locking member into the channel formed by the connecting walls of the second molding element. Edges of the flexible covering are then inserted between the side walls of the second locking member and the respective connecting wall of each so that, when the second locking member is snap-fit into the second molding element, these edges become trapped therein. Again, different dimensioning can be provided for the second molding element and the second locking member to increase design variety, and adhesives may be used to enhance the structural integrity of the system.

In addition to describing this framework assembly of molding strips, great advantages can be obtained by including, within the area covered, a core formed of a material that has either thermal insulating properties, acoustical insulating properties, or both. To this end, it is preferable that a core of spun fiberglass be provided between the surface that is covered and the flexible material. This spun fiberglass performs the dual role of controlling both heat transfer through the flexible covering assembly and the minimization of sound transfer therethrough. Thus, the spun fiberglass also tends to damp ambient sounds impacting thereon so as to minimize reflected sound from the surface area so covered.

These and other objects of the present invention will become more readily appreciated and understood from a consideration of the following detailed description of the preferred embodiment, when taken together with the accompanying drawings, in which:

DETAILED DESCRIPTION OF THE PREFERRED EMBODIMENT

The present invention relates to the mounting of flexible coverings, such as fabric panels and the like, to a support surface. The support surface may be any open area to be covered, but which usually takes the form of an interior wall which needs to be covered with a fabric panel. The present invention is specifically directed to novel and useful molding strips, and to an assembly thereof, which strips may be cut and connected to one another to define a framework that extends around the perimeter of the area to be covered. These molding strips are adapted to securely, yet releaseably, mount the flexible covering over the desired area. Accordingly, it is contemplated that molding strips according to the present invention may directly attach to a support surface at desired, user-selected positions. In addition, the present invention may be used to hang tapestries or other flexible coverings along one or more edges.

Figure 1:
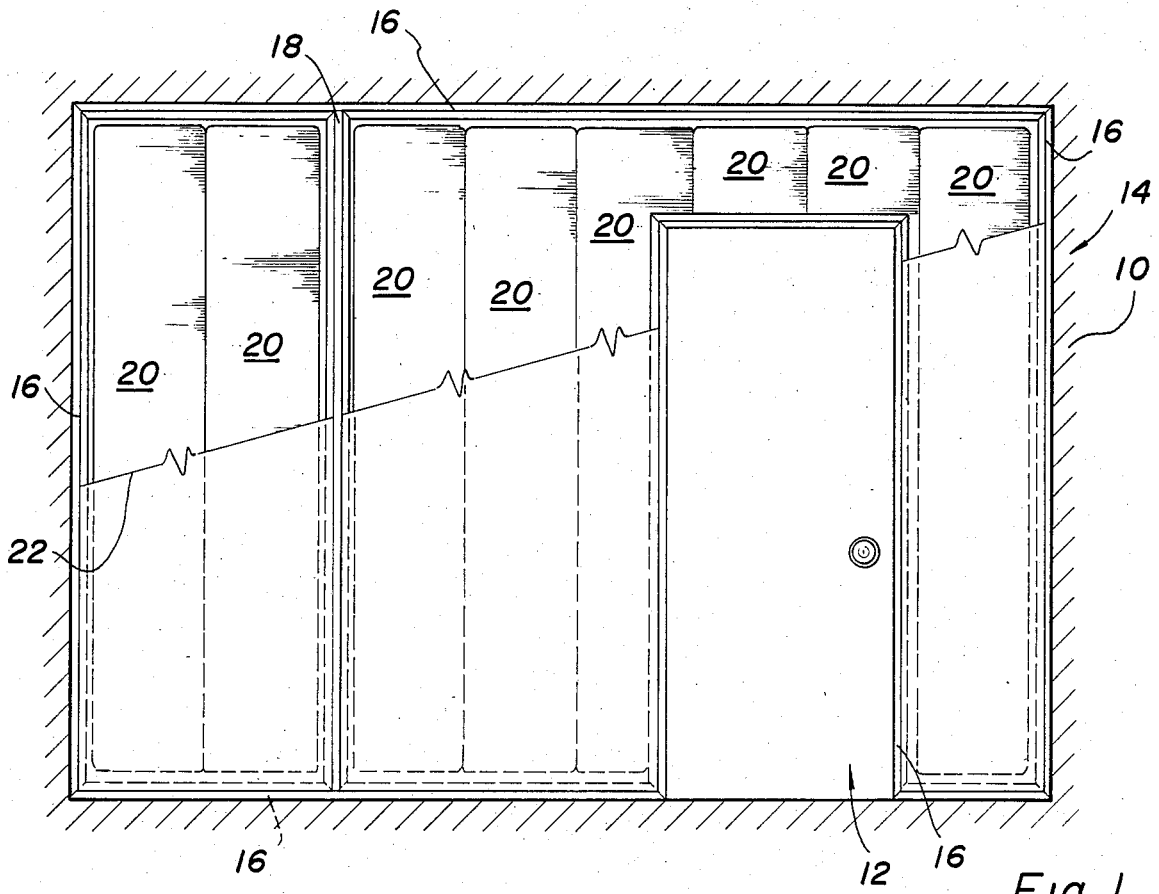
FIG. 1 is a front plan view of the molding assembly according to the preferred embodiment of the present invention shown attached onto the wall of a room.

While it should be appreciated that a framework formed by molding pieces according to the preferred embodiment of the present invention may take any generally planar geometric shape, a representative shape is shown in FIG. 1, which, for simplicity of explanation, is shown as a rectangular wall covering on an interior wall of a room. As is shown in FIG. 1, a room 10 includes door 12 so that an eight sided geometrical figure is defined to desribe an area that is covered by covering assembly 14. Covering assembly 14 includes a framework of molding strips 16 that extend around the perimeter of the area to be covered. Thus, edge molding strips 16 are positioned along the top, bottom and side edges of the wall as well as around door 12. Central cooperating or interior molding strips 18 extend vertically across a portion of wall 10 between molding strips 16 located at the top and bottom horizontal edges of wall 10. Acoustical damping and/or thermal insulating mat sections 20 are attached to wall 10 in the area to be covered and extend completely over this area so as to insulate the area against acoustical and thermal transfer. A flexible covering 22 extends across the area to be covered, over mat sections 20, and is attached to wall 10 by means of molding strips 16. Covering 22 may be any selected material, such as fabric or the like, selected to present a pleasing design appearance; several flexible panels may be required, depending upon their width, to cover this area.

Figure 2:
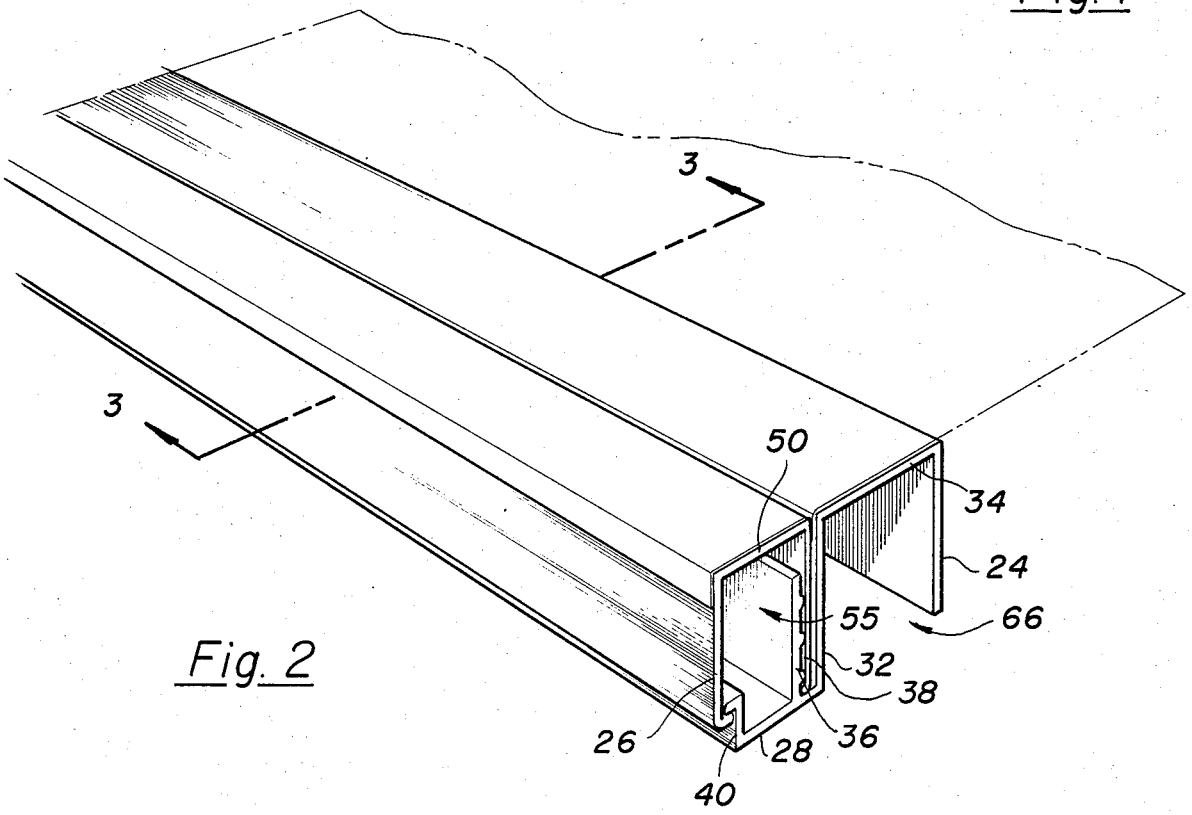
FIG. 2 is a perspective view of the edge molding strips according to the preferred embodiment of the present invention.
Figure 3:
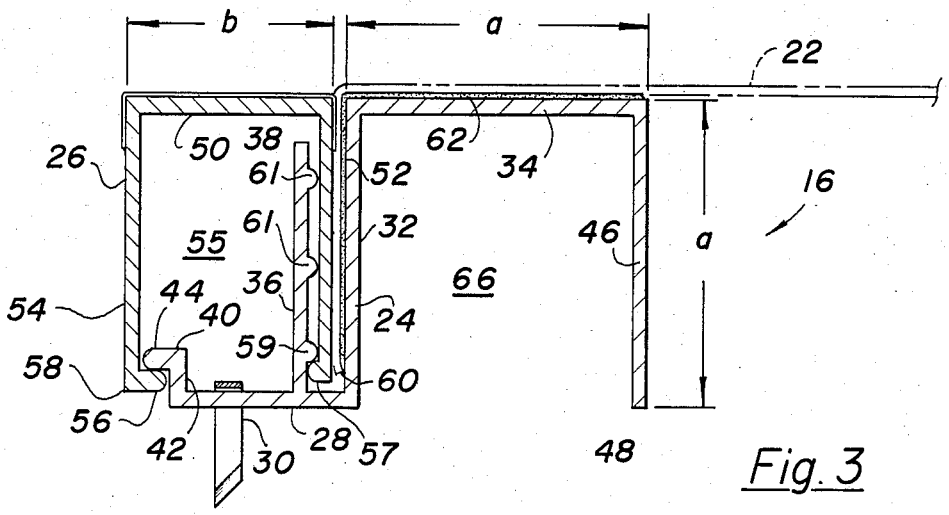
FIG. 3 is a cross-sectional view taken about lines 3—3 of FIG. 2.
Figure 4:
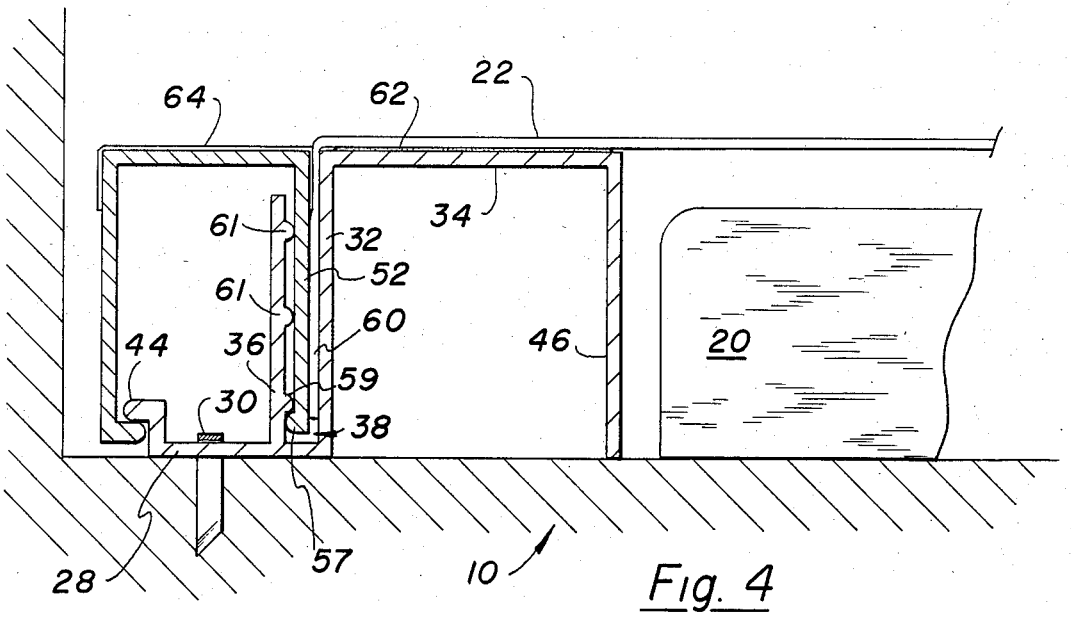
FIG. 4 is an end view in elevation of the molding strip assembly according to the preferred embodiment of the present invention shown at the junction of two perpendicular support surfaces.

The structure of molding strips 16 is shown in greater detail in FIGS. 2–4. As is shown in these figures, a molding element 24 and a locking member 26 form each molding strip 16. Molding element 24 includes a base wall 28 that is adapted to receive fastening elements, such as staples 30, for affixing molding element 24 to a support surface, such as wall 10. A connecting wall 32 extends upwardly from base wall 28, preferably along one edge thereof, with connecting wall 32 supporting a raised support wall 34 and generally parallel, offset relation to base wall 28. A retaining wall 36 also extends upwardly from base wall 28 in closely spaced, parallel relation to connecting wall 32 so as to define a narrow groove 38 therebetween. An upstanding lip 40 projects upwardly from base plate 28 along an edge thereof opposite connecting wall 32, and is defined by a web 42 that terminates in a laterally projecting shoulder 44 as is shown in FIGS. 3 and 4. In the preferred embodiment of the present invention, a spacer wall 46 depends downwardly from an edge of support wall 34 opposite connecting wall 32 and terminates in an edge 48 that is generally in the plane of base wall 28.

Locking member 26 is configured to snap-lock onto molding element 24. As is shown in FIGS. 2–4, locking member 26 has a top wall 50, a first side wall 52 and a second side wall 54. Side wall 52 depends downwardly from top wall 50 along one edge thereof and is sized for closefitting insertion into groove 38, and is preferably formed at a right angle with top wall 50. Second side wall 54 is preferably perpendicular to top wall 50 and depends downwardly from an edge of top wall 50 opposite a first side wall 52 to form a channel 55. Second side wall 54 terminates in an inwardly projecting rib 56 at a free edge 58, with side wall 54 being sized so that rib 56 will engage the underside of shoulder 44 when side wall 52 is inserted into groove 38. Thus, lip 40 and rib 56 form a locking means to snap-lock locking member 26 onto molding element 24. Accordingly, it should appreciated that the distance between web 42 and retaining wall 36 should be slightly smaller than the internal distance between first and second side walls 52 and 54. A second set of locking structures are used to further retain locking member 26 in mated engagement with molding element 24. This second locking structure includes facing ribs 57 and 59 on first side wall 52 and retaining wall 36, respectively. Ribs 57 and 59 abuttably engage one another, as is shown in FIGS. 3 and 4, when first side wall 52 is inserted into groove 38. Additional ribs may be included on either side wall 52 or retaining wall 36, such as ribs 61 shown on retaining wall 36 in FIGS. 3 and 4. Ribs 61 provide intermediate locking positions for locking member 26 and molding element 24.

The attachemnt of covering 22 to wall 10 by means of molding strips 16 may now be more fully appreciated with reference to FIGS. 3 and 4. As is shown in phantom in FIG. 3, and in greater detail in FIG. 4, a free edge 60 of covering 22 is trapped between connecting wall 32 of molding element 24 and first side wall 52 of locking member 26. To further secure covering 22, molding element 24 has a layer of adhesive 62 on an upper surface of support wall 34; adhesive 62 may also extend along the outer surface of connecting wall 32 to present a greater surface area of adherence.

Thus, to secure covering 22 onto molding strip 16, a portion of covering 22 adjacent marginal edge 60 is pressed onto adhesive layer 62 so that marginal edge portion 60 will be inserted downwardly into groove 38. Once such attachment by adhesive 62 is accomplished along the desired length of molding element 24, the user inserts first side wall 52 into groove 38 so that it forceably bears against marginal edge 60. Locking member 26 is then locked onto molding element 24 by snap-locking rib 56 around shoulder 44 with ribs 57 and 59 in abutting engaged relationship. The cooperation of adhesive 62 and the entrapment of marginal edge 60 thus securely affixes covering 22 onto molding element 24.

This attachment is further enhanced since marginal edge 60 is oriented at approximately a right angle to the main body of covering 22. Preferably, adhesive 62 is a pressure sensitive adhesive that has a high tack ability and which is adapted for application toward low porousity substrate. This adhesive should exhibit a reasonably good shear streangth that may be applied to molding element 24 so that a portion of adhesive 62 extends downwardly into groove 38 along connecting wall 32. A double stick tape may also be employed as adhesive 62.

The molding strip assembly described above may be employed to attach a wide variety of flexible coverings to a support surface, such as a wall 10. These materials may include fabric, leather, plastic vinyls or other plastic sheets, and other flexible material known in the art. This variety of coverings allows a wide variety of design possibilities and, to further increase the variety of different appearances which may be given by covering assembly 14, locking member 26 may be provided with a decorative covering 64 along an upper surface of its top wall 50, as is shown in FIGS. 3 and 4. Covering 64 may include fabrics that either match, contrast or complement covering 22, and can include fabric ribbons, metal foils, plastic foils, leather or the like; alternatively, locking member 26 can be color impregnated or painted. Further, although it is preferable to fabricate molding strips 16 out of an extruded plastic material, such as polyvinyl chloride, either or both of molding element 24 and locking member 26 may be formed out of other material, such as wood or metal so as to increase their variety of design appearances that may be obtained utilizing this covering assembly system.

With reference to FIG. 3, it is preferred that support wall 34 be oriented in spaced parallel relation to base wall 28 and offset laterally therefrom. Preferably, support wall 34 is oriented a distance "a" above base wall 28 with this distance being approximately one to two centimeters, although other dimensions are completely acceptable within the scope of this invention. Further, it is preferred that the width of support wall 34 be identical with its height above base wall 28, although, again, other relative dimensions are possible. The width "b" of top wall 50 of locking member 26 is preferably equal to or less than width "a" of support wall 34, and is preferably selected so that it is small enough so that locking member 26 may also be inserted into channel 66 defined by connecting wall 32, support wall 34, and spacer wall 46, if desired.

As noted above, molding strips 16 and covering 22 are particularly adapted to be used in conjunction to form a covering assembly 14 that includes acoustical/mat sections 20. Preferably, mats 20 are formed of a material, such as spun fiberglass, that performs a dual role of controlling both heat and sound. However, as is shown in FIG. 5, an acoustical core 21 could replace thermo-acoustical core 20 wherein acoustical core 21 would exhibit an even greater degree of sound dampening.

Figure 5:
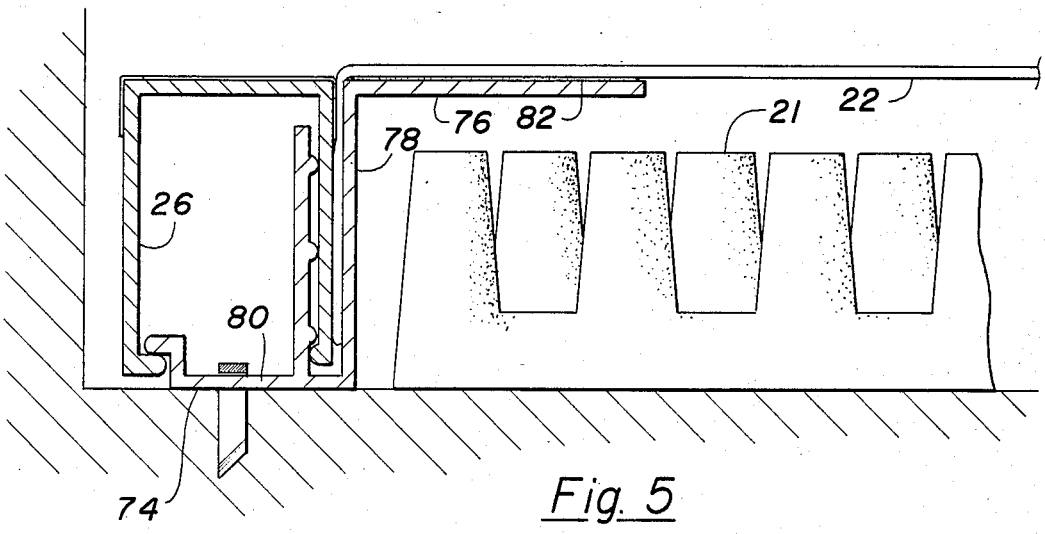
FIG. 5 is an end view in elevation of a first alternate embodiment of the edge modlingelement shown mounted on a support surface and used in conjunction with an acoustical baffle.

Further, with respect to the alternative embodiment shown in FIG. 5, it may be appreciated that spacer wall 46 be eliminated from the molding strip so that molding element 74 does not include a channel such as channel 66, described with respect to the preferred embodiment. By eliminating spacer wall 46, acoustical core 21 may be inserted underneath support wall 76 into closely spaced relation to connecting wall 78 that interconnects support wall 76 to base 80. Again, as is shown in FIG. 5, locking element 26 would be used with this alternate molding element 74. As described with respect to the preferred embodiment, an adhesive layer 82 may be used to help affix covering 22 onto the upper surface of support wall 76.

Typically, the surface area to be covered may have a greater dimension than a common width for covering 22 so that covering 22 may be formed as several sheet sections sewn together. In the alternative, and for design reasons, it may be desirable to separate the expanse of covering 22 into several discreet sections. This is accomplished, as is shown in FIG. 1, by means of cooperating interior molding strips, such as molding strip 18 which can be oriented vertically, horizontally or diagonally across the surface area to be covered.

Figure 6:
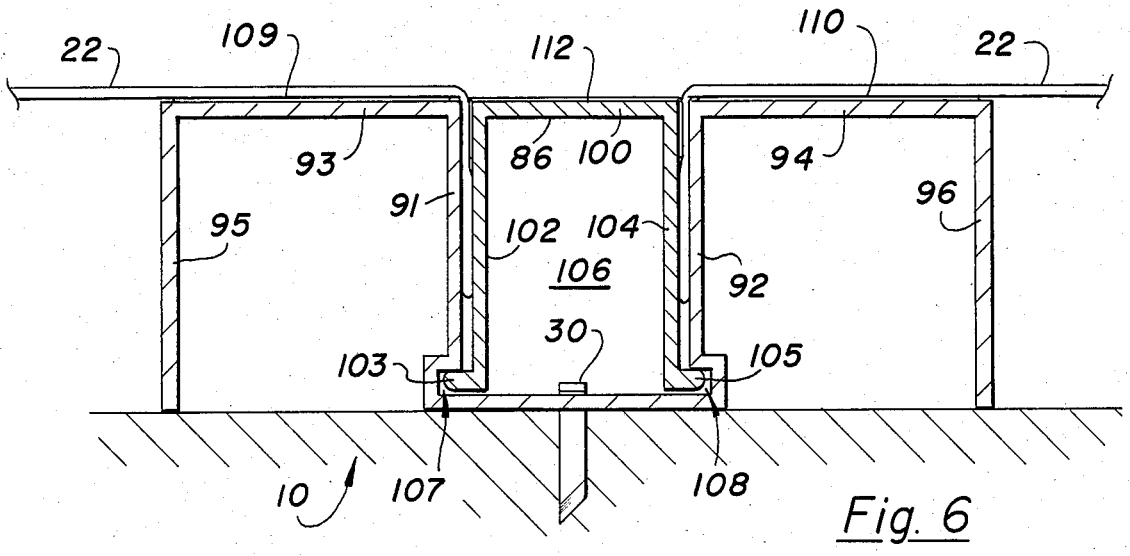
FIG. 6 is an end view in elevation as the interior molding strips used in cooperation with the molding strips shown in FIG. 2–4.

Interior molding strip 18 is shown in greater detail in FIG. 6 and includes molding element 84 and locking member 86 which are again formed preferably out of an extruded plastic, although other structural materials may be employed. Molding element 84 is secured to wall 10 by means of fasteners such as staples 30 mounted through base wall 88 between connecting walls 91 and 92. Connecting wall 91 extends upwardly from base wall 88 and interconnects an outwardly projecting support wall 93 in spaced apart relation above base wall 88. A spacer wall 95 further helps position support wall 93 above mounting surface 10. Similarly, connecting wall 92 extends upwardly from base wall 88 and positions a support wall 94 in spaced apart, offset relation from base wall 88. A spacer wall 96 further supports support wall 94 above wall 10. Spacer walls 95 and 96, while described, could be eliminated so that support walls 93 and 94 would define laterally projecting wings from connecting walls 91 and 92, respectively.

Locking member 86 includes a top wall 100 from which first and second side walls 102 and 104 downwardly depend. Side walls 102 and 104 are generally parallel to one and terminate in outwardly turned ribs or feet 103 and 105, respectively. Each of feet 103 and 105 form part of a locking structure so that locking member 86 will be securely retained in the channel 106 formed between connecting walls 91 and 92 of molding element 84. To this end, connecting walls 91 and 92 have channels 107 and 108, respectively, at their lower edges. Channels 107 and 108 are sized to engage feet 103 and 105 so that a snap-fit engagement obtains for locking member 86 into the channel 106 of locking member 86.

Further, side walls 102 and 104 are sized so that they position top wall 100 a substantially planar relationship with support walls 93 and 94 so that top wall 100 defines a reveal therebetween. As before, end portions 60 of coverings 22 may be inserted into channel 106 before locking member is mated therein so that end portions 60 become trapped against respective connecting walls 91 and 92 by side walls 102 and 104 of locking member 86. Adhesive layers 109 and 110 may be provided on the upper surfaces of support walls 93 and 94, and along connecting walls 91 and 92 if desired, to help adhere coverings 22 to molding element 84. An upper surface of top wall 100 of locking member 86 may also be provided with a decorate covering 112, all in a manner as described with respect to the preferred embodiment of the present invention.

While the above description with respect to FIGS. 1 through 4 and FIG. 6 describe the preferred embodiment of covering assembly 14, it should be appreciated that different embodiments of the present invention may be had by changing one or both of the molding elements and locking members. Such alternate embodiment has already been described with respect to FIG. 5 wherein support wall 76 is not supported by a spacer wall so as to allow closer insertion of the acoustical and/or thermal mat sections such as acoustical core 21. Another alternate embodiment is shown in FIG. 7 which provides a routing channel in conjunction with the molding strips.

Figure 7:
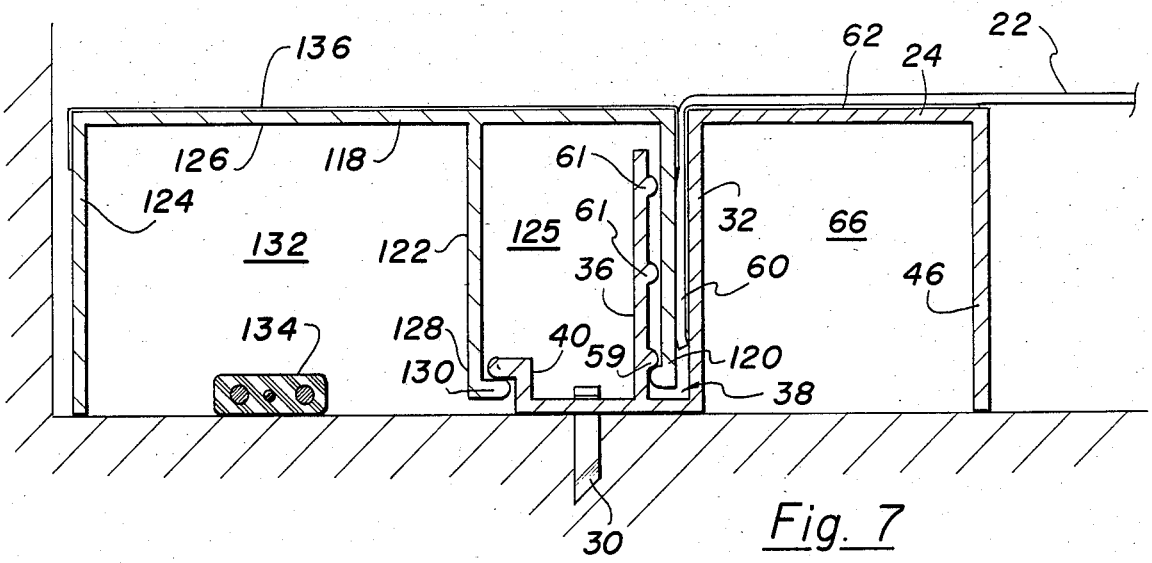
FIG. 7 is an end view in elevation of mounting strips according to a first alternate embodiment of the locking element on a support surface at the juncture thereof with a perpendicular support surface.

In FIG. 7, an alternate locking member 116 is provided to mate with molding element 24. Specifically, as is shown in FIG. 7, locking member 116 includes a substantially wider top wall 118. A first side wall 120 that depends downwardly from one edge of top wall 118 and is sized for insertion into groove 38 formed by connecting wall 32 and retaining wall 36 of molding element 34. Side wall 120 terminates in a rib 121 that engages rib 59. A second side wall 122 depends downwardly from a central portion of top wall 118 and is comparable to locking wall 52 described with respect to the preferred embodiment of the present invention. Locking wall 122 includes a locking structure on its lower free edge 128 which is formed as an inwardly projecting rib 130 that releaseably mates with lip 40 of molding element 24. Thus, channel 125 is formed between side wall 120 and locking side wall 122 of locking member 116 and is similar to channel 55 described with respect to the preferred embodiment of the present invention.

As noted above, top wall 118 is substantially wider than top wall 50 and includes a laterally projecting wall portion 126. An outer wall 124 depends downwardly from the edge of top wall portion 126 so that top wall portion 126, along with locking side wall 122 and outer wall 124, define a channel-like chamber 132 therein. Locking member 116 may be formed of any selected size so that channel 132 may be of a selected dimension. Channel 132 may be employed as a conduit to cover an electrical line or a telephone cable 134, as is shown in FIG. 7. Thus, when covering assembly 14 is selected for use to cover a surface area, such as a room wall, locking member 116 may be employed, for example, along the bottom edge to provide a cable conduit that provides telephone lines or other electrical wires, such as speaker wires, to be hidden from view. Any selected decorative covering 136 may be attached to the upper surface of top wall 118 to obtain the design variety.

Figure 8:
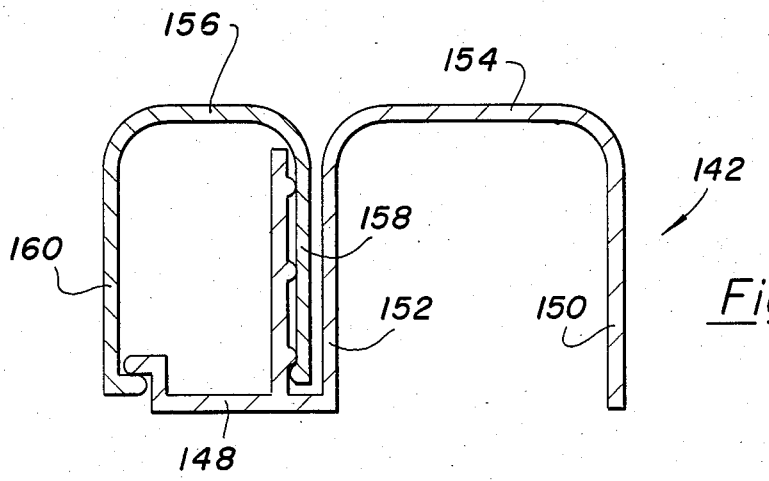
FIG. 8 is an end view in elevation of a second alternate embodiment of the edge molding element and the locking member of the present invention.

A third alternate embodiment of the present invention is shown in FIG. 8. In this embodiment, molding elemnt 144 and locking element 146 are constructed similarly to molding element 24 and locking member 26 of the preferred embodiment. However, molding element 144 is contoured, having a rounded support wall 154 that is positioned in spaced apart offset relation from base wall 148 by connecting wall 152 and spacer wall 150. Similarly, locking member 146 is contoured, having a rounded top wall 156 positioned between side wall 158 and locking wall 160. Arcuate support wall 154 and top wall 156 provide a "bull nose" appearance when molding strip assembly 42 is used with respect to covering a surface.

Figure 9:
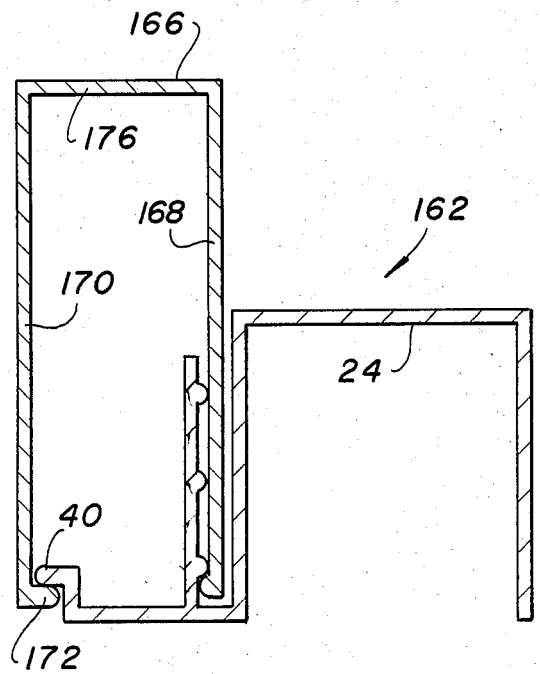
FIG. 9 is an end view in elevation of the molding element according to the preferred embodiment of the present invention used in conjunction with a third alternate embodiment of the locking member.

Yet another strip assembly embodiment is shown in FIG. 9 wherein strip assembly 162 includes molding element 24 used in conjunction with an alternate locking member 166. Here, locking member 166 includes a side wall 168 that has a thickness that allows insertion into groove 38 and a locking wall 170 that supports rib 172 that engages lip 40 of molding element 24. Walls 168 and 170 position top wall 176 of locking member 166 in a spaced relation from support wall 34 thereby providing a "stair step" appearance. Specifically, as is seen in FIG. 9, top wall 176 is not in a common plane with support wall 34; when used, then, strip assembly 62 allows the designer to give the appearance of depth to the wall to the stair step construction.

Figure 10:
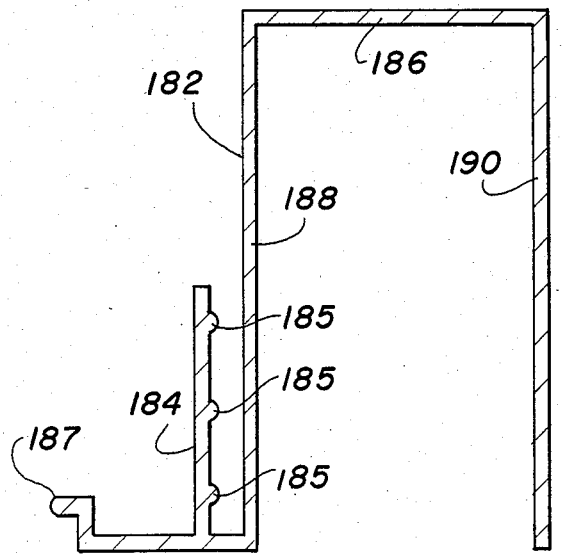
FIG. 10 is an end view in elevation of a third alternative embodiment of the edge molding element incorporating the locking element of FIG. 9.

In the embodiment shown in FIG. 10, an alternate molding element 182 may be used with either of locking member 26 or locking member 166, described above. Here, molding element 182 has a height that is greater than the width of support wall 186 so that support wall 186 is substantially co-planar with top wall 176 of locking member 166 when they are used together. To accomplish this, connecting wall 188 is increased in height, and spacer wall 190 is increased in height, so that they each match the length of side wall 168 and locking wall 170. Retaining wall 184 is also provided and has ribs 185 and lip 187, similar to molding element 24.

Figure 11:
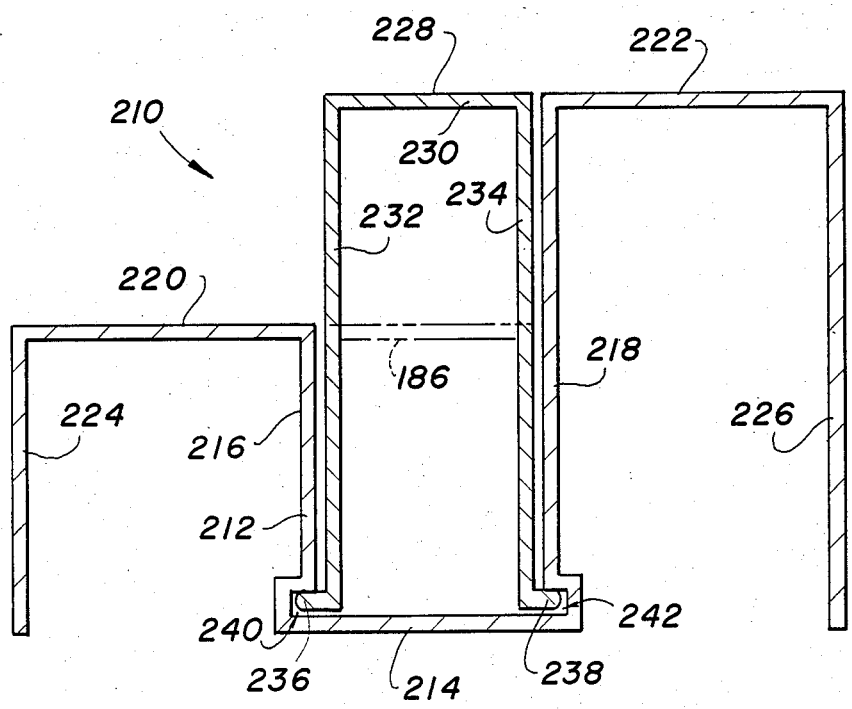
FIG. 11 is an end view in elevation of a first alternate embodiment of the interior molding strips shown in FIG. 6.

An alternate embodiment of the interior or cooperating molding strips is shown in FIG. 11, with this alternate embodiment being constructed to give the stair step design possibilities similar to the alternate embodiments of the edge strips shown in FIGS. 9 and 10. Specifically, interior molding strip assembly 210 includes a molding element 212 that has a base wall 214 adapted to receive fasteners for attaching molding element 212 to a support surface such as a wall. Connecting walls extend upwardly from the edges of base wall 214, and include a short connecting wall 216 that corresponds in height to connecting walls 91 and 92 of FIG. 6. An elongated connecting wall 218 corresponds in height to connecting wall 188 of FIG. 10. A first top wall 220 is spaced above base wall 214, laterally offset therefrom, and is supported by connecting wall 216; a second top wall 222 is supported by connecting wall 218 and projects laterally therefrom, in an opposite direction from top wall 220. Thus, top walls 220 and 222 are located in spaced apart, parallel planes to provide a stair step appearance for interior molding strip assembly 210. A spacer wall 224 helps support top wall 220 and depends downwardly from an edge thereof opposite connecting wall 216. Similarly, elongated spacer wall 226 depends downwardly from an edge of top wall 222 opposite connecting wall 218 to help support top wall 222 on the support surface.

An elongated locking member 228 includes a top wall 230 and a pair of downwardly depending side walls 232 and 234 which are of a length corresponding to connecting wall 218. A locking structure similar to that described with respect to molding element 84 and locking member 86 is provided on the lower edges of side wall 232 and 234. This locking structure includes ribs 236 and 238, respectively, that mate with channels 240 and 242 along the lower edges of connecting walls 216 and 218, respectively, adjacent base wall 214. It should also be appreciated that locking member 86 may be used in conjunction with molding element 212 in place of locking member 228, so that different design appearances are possible. The use of locking member 86 is thus shown, in phantom, in Figure 11.

Figure 12:
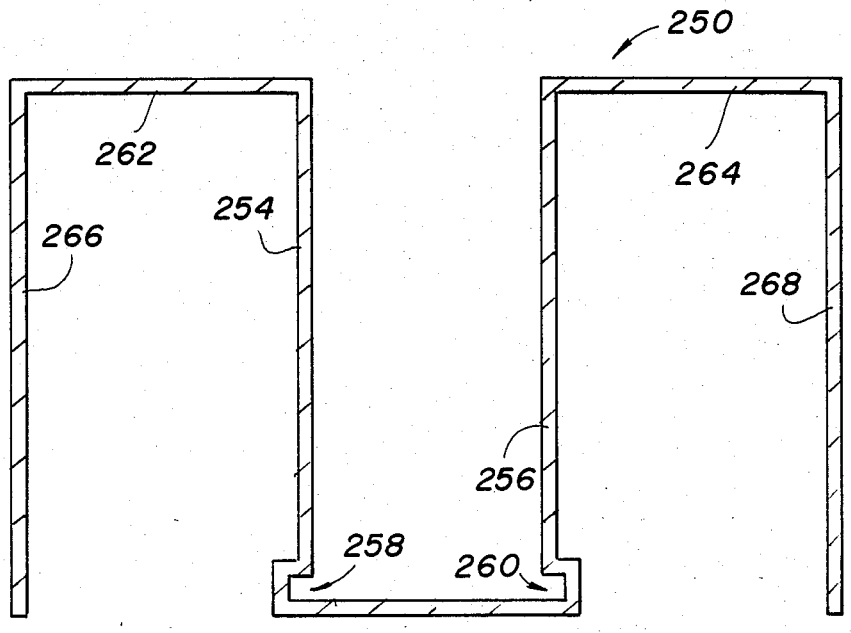
FIG. 12 is a second alternate embodiment of the interior molding strips.

Another alternate embodiment of the molding element for the interior molding strip assembly is shown in FIG. 12, and it should be appreciated that this assembly is provided so that both upper support walls are again coplanar but which molding element is constructed to have elongated connecting walls and elongated spacer walls. Specifically, as is shown in FIG. 12, molding element 250 includes a base wall 252 which has first and second connecting walls 254 and 256. A channel 258 is located at the lower edge of connecting wall 252, and a channel 260 is located at a lower edge of connecting wall 256, similar to the manner described above. Connecting wall 254 supports a support wall 262 in spaced offset relation to base wall 252, and connecting wall 256 supports a similar support wall 264 in spaced, offset relation to base wall 252 with support walls 262 and 264 being substantially coplanar. A downwardly depending spacer wall 266 is connected to support wall 262 and is in substantially parallel relation to connecting wall 254. Likewise, elongated spacer wall 268 depends downwardly from support wall 264 in substantially parallel relation with connecting wall 256. Again, molding element 250 may be utilized with either of locking member 86 or 228.

Figure 13:
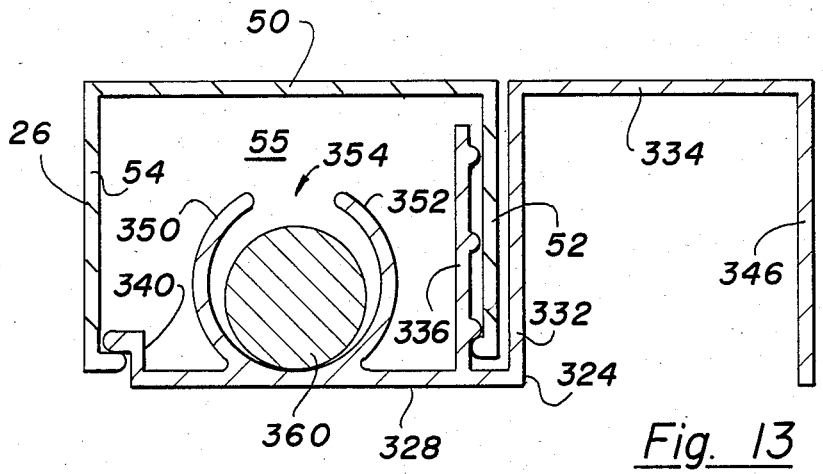
FIG. 13 shows a fourth alternate embodiment of the edge molding element and the locking member.
Figure 14:
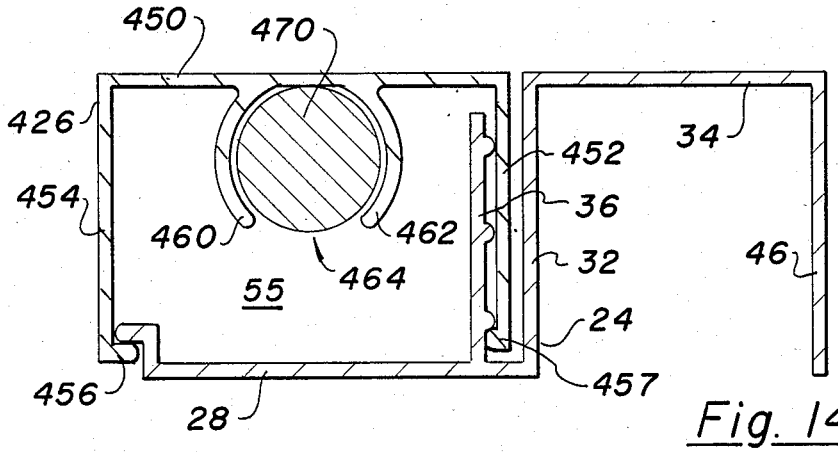
FIG. 14 is a fifth alternate embodiment of the edge molding element and the locking member.

Two final alternate embodiments of the present invention are shown in FIGS. 13 and 14, with each of these figures including gripping legs for gripping a cable or the like in the channel formed by the edge molding element and the locking member associated therewith. In FIG. 13, an alternate embodiment of the molding element is shown as molding element 324 which includes a base wall 328, a connecting wall 332, a support wall 334, a spacer wall 346, a retaining wall 336 and a lip 340 similar to that described with respect to the preferred embodiment of the present invention. However, molding element 324 includes a pair of upstanding and inwardly turned legs 350 and 352 between lip 340 and retaining wall 336. These legs define a channel 354 that may releaseably retain a cable, such as fiber optic cable 360 therein. The use of inwardly turned legs 350 and 352 securely mount cable 360 so that it is constrained in a desired located within the molding strip assembly. Molding element 324 is then used with the standard locking element 26 described with respect to the preferred embodiment.

Similarly, in FIG. 14, a standard molding element 24 is provided, but a modified locking member 426 is employed therewith. Locking member 426 includes a top wall 450 from which downwardly depends a pair of side walls 452 and 454 which terminate with inwardly turned ribs 456 and 457, respectively. A pair of downwardly depending, inwardly turned legs 460 and 462 define a channel 464 therebetween to receive a wire, cable, fiber optic element such as fiber optic cable 470. Again, this structure is provided to rigidly, yet releaseably, secure a cable within channel 55.

From the foregoing, it should be appreciated that a framework to support a flexible covering may be fabricated from the various ones of the edge molding strip assemblies and the interior molding strip assemblies. The outer perimeter of this framework is preferably formed of the edge molding strip assemblies which may be miter cut to form the desired framework with the interior molding pieces being utilized for design variety as well as to accommodate large areas where the flexible panels used to form covering 22 are not of sufficient unitary width to cover the entire surface area. The user may select various design materials to provide a wide variety of appearances to reach a desired aesthetic goal, and the use of thermal and acoustical insulating materials 20 and 21 provide for energy efficient surface covering that also retards sound transfer.

To assemble the wall covering assembly 10, it is preferred that the desired molding elements be attached to the support surface in the desired geometric configuration (including interior molding strips, if necessary) with the support walls of the edge molding elements extending inwardly from the framework perimeter. The acoustic/thermal matting is then attached to support surface, within the perimeter, over the area to be covered. Next, the flexible covering is adhered to the top edge molding element and then draped downwardly to be snuggly adhered to the bottom molding element. The covering is then stretched to either side and adhered to the side edge molding elements, and a broad knife is used to trim off all unwanted excess edge portions of the covering. The locking members are then secured to the molding elements competely around the framework perimeter (including the interior molding strips, if necessary) to present a beautiful, acoustical and thermally efficient covering for the support surface.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A molding strip assembly adapted to secure an edge of a flexible covering to a surface to which the molding strip is attached, comprising:

a molding element having a relatively flat base wall operative to receive fastening elements for attaching said molding elements to said surface, a connecting wall extending upwardly from the base wall, a raised lip extending upwardly from the base wall in spaced relation to the connecting wall, a retaining wall extending upwardly from said base wall in closely spaced relation to the connecting wall to define a narrow groove therebetween, and a raised support wall connected to the connecting wall and supported thereby in spaced relation to the base wall; and a locking member having a top wall and first and second side walls depending downwardly therefrom, said first side wall sized for insertion into said groove, said second side wall including locking means for engaging said lip to retain the locking member on said molding element with said first side wall in mated engagement with said groove, whereby the covering may be secured to said surface by training its edge across said support wall, along said connecting wall and into said groove after which the locking member is secured to said molding element so that the first side wall thereof traps the edge of the covering in said groove.

2. A molding strip according to claim 1 wherein said molding element has a spacer wall extending downwardly from said support wall in spaced relation to said connecting wall and terminating generally in the plane of said base wall.

3. A molding strip according to claim 1 wherein said support wall is substantially flat and is oriented generally parallel to said base wall, said base wall and said support wall being laterally offset from one another.

4. A molding strip according to claim 1 wherein said support wall has a contoured portion whereby said covering follows such contoured portion as it is trained thereover, said top wall having a contoured portion matching the contour of the support wall.

5. A molding strip according to claim 1 wherein a substantial portion of the upper surface of said support wall is coated with an adhesive substance whereby said covering may be positively adhered thereto.

6. A molding strip according to claim 1 wherein said top wall has an upper surface which is covered with a decorative material.

7. A molding strip according to claim 6 wherein said decorative material is selected from a group consisting of: fabric, metallic foil, wood, leather, plastic foil, and paint.

8. A molding strip according to claim 1 wherein locking means includes a first rib on said second side wall and facing and engaging said lip to secure said locking member to said molding element.

9. A molding strip according to claim 8 wherein said first side wall and said retaining wall include cooperating second locking emans for securing said locking member to said molding element.

10. A molding strip according to claim 9 wherein said second locking means includes a second rib on said first side wall and a third rib on said retaining wall, said second and third ribs oriented to abuttably engage one another when said first side wall is positioned in said groove.

11. A molding strip according to claim 10 including at least one fourth rib on one of said first side wall and said retaining wall positioned in parallel relation to and above the respective second or third rib and operative to provide an intermediate locking position of said locking member to said molding element.

12. A moldling strip according to claim 1 further including an outer wall extending downwardly from said top wall in spaced relation to said second side wall, said second side wall being positioned between said outer wall and said first side wall to define a channel sized for receiving electrical cable and the like.

13. A molding strip according to claim 1 wherein said base wall has a pair of upwardly extending legs positioned between said lip and said retaining wall sized and adapted to receive a cable therebetween.

14. A molding strip according to claim 13 wherein said legs are curved toward one another.

15. A molding strip according to claim 1 wherein said top wall has a pair of downwardly depending legs positioned between said first and second side walls sized and adapted to receive a cable therebetween.

16. A molding strip according to claim 15 wherein said legs are curved toward one another.

17. An assembly of border pieces defining a support structure for a flexible covering operative to cover a support surface over an area of selected geometric configuration, said covering having dimensions slightly larger than the dimensions of said area to present excess edge portions around the outer perimeter of the support structure, the assembly comprising:

edge molding elements, each of which having a base wall operative to receive fastening elements whereby said molding element is attached to the support surface, a first connecting wall extending upwardly from the base wall, a lip extending upwardly from the base wall in spaced relation to the connecting wall, a retaining wall extending upwardly from said base wall to define a groove therebetween, and a raised support wall connected to the first connected wall and supported thereby in spaced relation to the base wall, said edge molding elements attached to the support surface in end-to-end relationship to define the perimeter of the area to be covered, the respective grooves of said edge molding elements forming an upwardly opening, narrow channel around the perimeter of the area to be covered whereby the excess edge portions of the covering may be placed in the groove; and locking members each of which having a top wall and a first and second side walls depending downardly therefrom, said first side wall sized for insertion into a corresponding groove portions of said molding elements to trap a corresponding edge portion of the covering therein between the first side wall and the first connecting wall of the corresponding molding element, each said second side wall having locking means for engaging a correspondng lip to retain the locking member on its corresponding molding element.

18. The assembly of border pieces according to claim 17 wherein said covering is formed of at least two panels having facing panel edges located interiorly of said area further including interior molding strips for securing the panel edges, said interior molding strips including at least one interior molding element having a second base wall and second and third connecting walls extending upwardly therefrom in spaced, facing relation to one another, and second and third support walls supported in spaced relation to said second base wall by said second and third connecting walls, respectively whereby said facing panel edges may be placed across said second and third support walls and alongside said second and third connecting walls, and at least one second locking member insertable between said second and third connecting walls of a corresponding interior molding element, each second locking member having a second top wall and third and fourth side walls depending downwardly therefrom and operative to trap the panel edges against corresponding second and third connecting walls, and including second locking means for retaining said second locking member on its respective interior molding element.

19. The assembly of border pieces according to claim 18 wherein said second locking means includes a channel structure associated with each of said second and third connecting walls adjacent said second base wall and laterally projecting second and third ribs on the free edges of said third and fourth side walls, respectively, and positioned to engage said channel structures.

20. The assembly of border pieces according to claim 18 wherein said second and third support walls are relatively co-planar.

21. The assembly of border pieces according to claim 18 wherein said second and third support walls are located in spaced apart planes.

22. The assembly of border pieces according to claim 21 wherein said second top wall is relatively co-planar with one of said second and third support walls.

23. The assembly of border pieces according to claim 17 including acoustical damping and thermally insulating material on said support surface within said area.

24. The assembly of border pieces according to claim 17 including second locking means on said first side wall and on one of said first connecting wall and said retaining wall for retaining said first side wall in a corresponding said groove.

25. The assembly of border pieces according to claim 18 wherein said first, second and third support walls are relatively co-planar when the edge and interior molding elements are mounted on a planar support surface.

* * * * *